United States Patent [19]

Magedanz et al.

[11] 4,388,174

[45] Jun. 14, 1983

[54] PROCESS OF RECOVERING OIL FROM OIL-CONTAINING MINERALS

[75] Inventors: Norbert Magedanz, Hasselroth; Horst Seidel; Hans J. Weiss, both of Frankfurt am Main, all of Fed. Rep. of Germany

[73] Assignee: Metallgesellschaft Aktiengesellschaft, Frankfurt am Main, Fed. Rep. of Germany

[21] Appl. No.: 387,072

[22] Filed: Jun. 10, 1982

[30] Foreign Application Priority Data

Jun. 19, 1981 [DE] Fed. Rep. of Germany ..... 3124019

[51] Int. Cl.[3] ..... C10G 1/00; C10B 49/18; C10B 51/00; C10B 53/06

[52] U.S. Cl. ..... 208/11 R; 208/8 R; 201/32; 201/34

[58] Field of Search ..... 208/8 R, 11 R; 201/32, 201/34

[56] References Cited

U.S. PATENT DOCUMENTS

| | | | |
|---|---|---|---|
| 1,918,162 | 7/1933 | Willson | 201/32 X |
| 3,325,395 | 6/1967 | Ban | 201/32 X |
| 3,350,280 | 10/1967 | West | 208/11 R |
| 3,449,211 | 6/1969 | Gorand et al. | 208/11 R X |
| 3,483,115 | 12/1969 | Haddad et al. | 201/32 X |
| 3,560,369 | 2/1971 | Rowland et al. | 201/32 X |
| 3,703,442 | 11/1972 | Rammler et al. | 208/11 R X |
| 4,193,862 | 3/1980 | Ban et al. | 208/11 R |
| 4,258,005 | 3/1981 | Ito et al. | 201/31 X |
| 4,347,119 | 8/1982 | Thomas | 208/11 R |

*Primary Examiner*—Delbert E. Gantz
*Assistant Examiner*—Glenn A. Caldarola
*Attorney, Agent, or Firm*—Sprung, Horn, Kramer & Woods

[57] ABSTRACT

Oil-containing materials and part of the hot burnt material which is available after the combustion of solid carbon are charged into a retorting shaft reactor and the oil-containing mineral in the mixture is heated to the retorting temperature. For a processing even of minerals consisting of coarse lumps at high throughput rates and with a high oil yield, part of the retorting is effected in the retorting shaft reactor, the mineral from the retorting reactor is charged onto a traveling grate, the remaining retorting is effected in an after-retorting zone, in which inert or reducing gases are passed through the material, the gases from the retorting reactor and from the after-retorting zone are supplied to the separating stage and oil is removed from said gases in the separating stage, the retorted material is moved on the traveling grate to a combustion zone, the solid carbon in the surface of the bed is ignited at the beginning of the combustion zone, oxygen-containing gases are then sucked through the bed to cause the burning zone to move through the bed, the rate at which said oxygen-containing gases are sucked through the bed is preferably so controlled that the bed is heated to the highest possible temperature by the combustion of solid carbon, the burnt mineral is discharged from the traveling grate and part of the burnt material is recycled to the retorting reactor.

9 Claims, 1 Drawing Figure

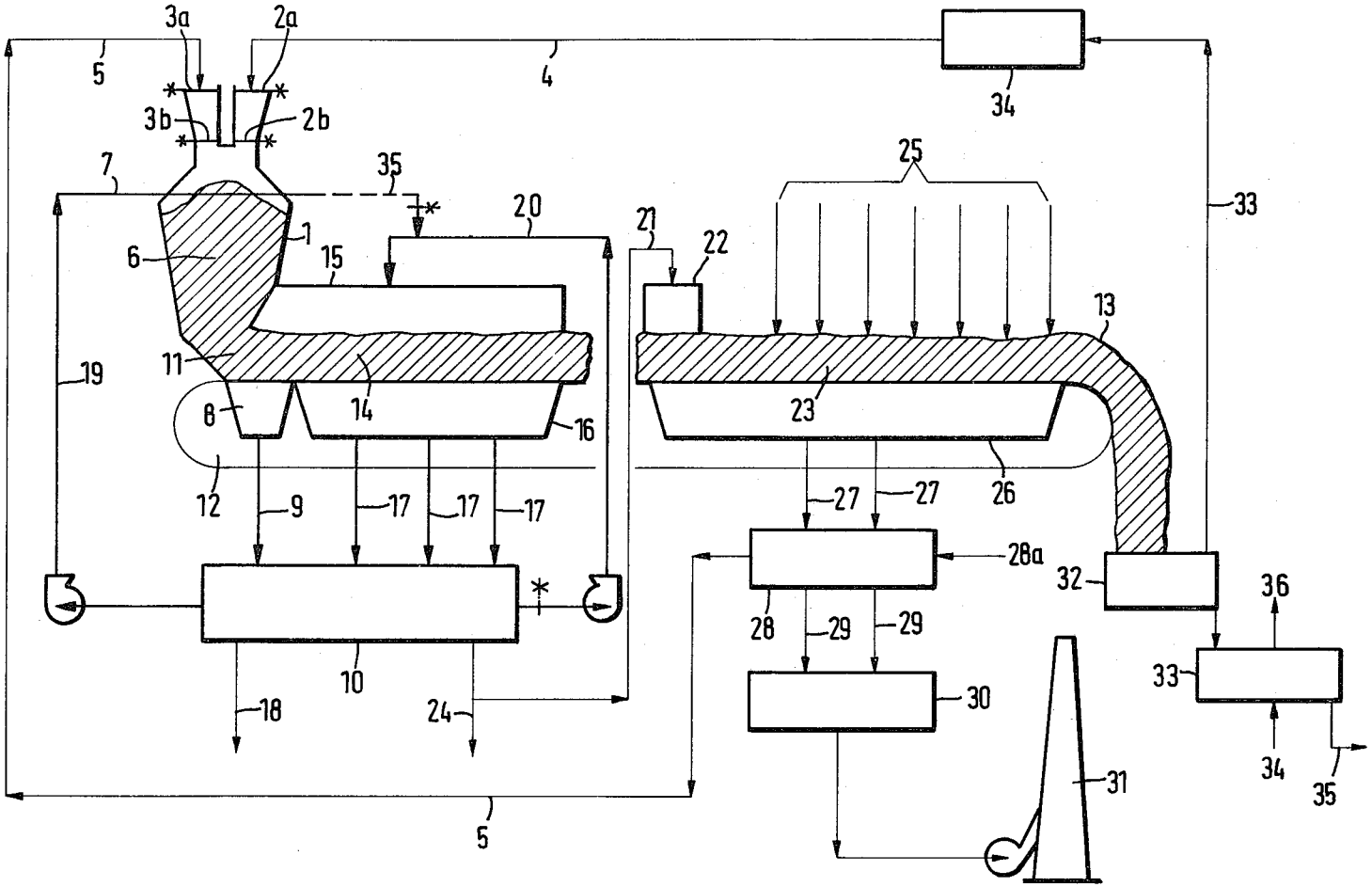
1
2a
2b
3a
3b
4
5
6
7
8
9
10
11
12
13
14
15
16
17
18
19
20
21
22
23
24
25
26
27
28
28a
29
30
31
32
33
34
35
36

PROCESS OF RECOVERING OIL FROM OIL-CONTAINING MINERALS

BACKGROUND OF THE INVENTION

1. Field of the Invention

This invention relates to a process of recovering oil from oil-containing minerals by retorting and a separation of oil from the retort gases which contain the oil vapours, wherein solid carbon contained in the retorted material after the retorting is burnt by a supply of oxygen-containing gases, part of the burnt hot mineral together with the oil-containing mineral is charged into a retorting shaft reactor and the oil-containing mineral is heated in the mixture to the retorting temperature.

2. Discussion of Prior Art

Oil-containing minerals, such as oil sand, diatomaceous earth and particularly oil shale are heat-treated and retorted for recovery of their oil content. For retorting, they are heated to the retorting temperature of about 400° to 600° C. in a neutral or reducing atmosphere with the exclusion of oxygen, whereby various gases and vapors are evolved from the organic constituents. The oils are condensed from the retort gases. After the condensation, the gas still contains gaseous retorting products which cannot be condensed. The retorted residue contains solid carbon as a retorting product. For the sake of heat economy, that carbon must be burnt and the resulting heat must be utilized for the process.

It is known from U.S. Pat. No. 3,703,442 to charge fresh oil shale and hot, spent shale to a retorting shaft reactor. The hot spent shale in the mixture heats the oil shale to the retorting temperature. The gaseous and vaporous retorting products which result from the retorting are withdrawn from the top of the retorting reactor. The retorted shale is withdrawn at the bottom and is raised in a pneumatic conveyor by means of oxygen-containing gases so that the solid carbon is burnt. The hot spent shale is separated from the entraining gas and is recharged to the retorting reactor. If the throughput rates are high, the retorting is effected in a screw conveyor, which is succeeded by a degasifying reactor. In that process the entire material must have a relatively small particle size.

It is an object of the invention to process also relatively coarse lump materials at high throughput rates and with a high oil yield in a process using a retorting shaft reactor.

This object is accomplished in accordance with the invention in that part of the retorting is effected in a retorting shaft reactor, the mineral from the retorting reactor is charged onto a traveling grate, the remaining retorting is effected in an after retorting zone, in which inert or reducing gases are passed through the material, the gases from the retorting reactor and from the after-retorting zone are supplied to the separating stage and oil is removed from said gases in the separating stage, the retorted material is moved on the traveling grate to a combustion zone, the solid carbon in the surface of the bed is ignited at the beginning of the combustion zone, oxygen-containing gases are then sucked through the bed to cause the burning zone to move through the bed, the rate at which said oxygen-containing gases are sucked through the bed is so controlled that the bed is heated to the highest possible temperature by the combustion of solid carbon, the burnt material is discharged from the traveling grate and part of the burnt material is recycled to the retorting reactor.

The fresh oil-containing material and the recycled hot mineral which has been burnt are charged into the retorting reactor with an exclusion of air. Charging may be effected continuously or in batches. The materials may be charged in layers onto the surface of the pile of material in the retorting reactor or the streams of material may be mixed as they fall freely before they impinge on the surface. Burnt material is recycled at such a rate that the heat content of said material is sufficient to effect the retorting of the fresh oil-containing material when both materials have been mixed.

The retorting reactor may precede the traveling grate and may be connected to the traveling grate only by a discharge device. Alternatively, the retorting reactor may be arranged over the beginning of the traveling grate. In that case, the discharged mineral is supported directly by the traveling grate. The discharge opening or the discharge device of the retorting reactor is shielded against an ingress of air.

The retorting in the retorting reactor can be effected with or without a supply of gases to the retorting reactor. If no gases are supplied, the gases leaving the reactor consist only of the gases produced by the retorting. If inert or reducing gases are supplied, gases leaving the reactor will consist of the gases supplied and of the gases produced by the retorting. The division of the retorting process into the retorting in the retorting shaft reactor and the remaining retorting in the after-retorting zone on the traveling bed is desirable in the processing of minerals which consist of coarse lumps or have a fraction consisting of large lumps and is carried out in such a manner that the supply of inert or reducing gasses, to control reaction kinetics, to the retorting and/or after-retorting zone is minimized.

In dependence on the retorting behavior and the particle size distribution of the oil-containing mineral, the retorting process is preferably performed in the retorting shaft reactor or in the after-retorting zone on the traveling grate. The rates at which the two gas streams are supplied to the respective retorting zones per unit of material depend also on the reaction kinetic requirements. The gases from the retorting reactor are preferably sucked from the lower part of said reactor because in that case the gases are conducted from the point where the recycled hot mineral is mixed with the fresh oil-containing mineral and an improved temperature control is realized while the paths to the separating stage are shorter.

The inert or reducing gases can consist of gases from which oil has been removed in the separating stage or of extraneous gases. A virtually complete retorting is effected in the after-retorting zone. The combustion of the solid carbon in the combustion zone is so controlled that the temperature in the bed and therewith in the exhaust gases is as high as possible. For this purpose the rate at which the oxygen-containing gases consisting generally of air is suitably controlled. The gas rate is increased until the exhaust gas temperature has reached its maximum. This is then the optimum gas rate. A drop of the exhaust gas temperature indicates that the gas rate is higher than its optimum. The solid carbon may not be completely burnt in some cases. This is intentionally tolerated. Particularly, with large particles it may be more desirable to burn only the solid carbon in the outer portions of the particles whereas the carbon in the interior is not burnt. Part of the gas withdrawn from the separating stage may be used to ignite the solid carbon in the combustion zone, in which the non-condensible combustion retorting products contained in the gas are thus burnt.

In a preferred embodiment the retorting reactor is disposed over the first portion of the traveling grate and the gases are sucked from the retorting reactor through the traveling grate.

In a preferred embodiment, inert or reducing gases are supplied to the upper portion of the retorting shaft reactor. This accelerates the reaction kinetics of the retorting in the retorting reactor. The rate at which gases are supplied is minimized.

In a preferred embodiment a partial stream of the gases from which oil has been removed is recycled as retort gas to the retorting stages. As the gases leaving the separating stage still contain the non-condensible retorting products which result from the retorting, the recycled gas has a high heating value.

In a preferred embodiment, vibration is imparted to the gases in the retorting zones. This improves the reaction kinetics at given gas rates in the retorting zones or permits use of lower gas rates for the desired reaction kinetics.

In a preferred embodiment a lower specific gas rate is supplied to the retorting reactor than to the after-retorting zone. As a result, the entire retorting process can be effected with a lower rate of retort gas. The longer residence time of the mineral in the retorting shaft reactor results in a prolonged time in which the reaction kinetics are performed so that a lower specific rate of retort gas is sufficient there. The remaining retorting on the traveling rate is then performed with a higher volume of retort gas per unit of material.

In a preferred embodiment, the particle stream of burnt material to be recycled is reheated before it is supplied to the retorting reactor. The reheating is suitably effected by a combustion of gas from the separating stage but may also be effected with extraneous energy. By the reheating, losses of heat from the recycled burnt material due to long-distance transportation or cold outside temperatures can be compensated in which case a recycling of mineral at a lower rate is sufficient.

In a preferred embodiment, the heat of the exhaust gas from the combustion zone is used to dry and preheat the oil-containing material and/or to heat gases to be supplied to the process. Gases to be supplied to the process are gases which are to be supplied to the retorting zones, to the means for igniting the solid carbon and to the means for reheating the mineral to be recycled. In this way the waste heat content fo the exhaust gas can be utilized for the process in a desirable manner.

In a preferred embodiment, the hot mineral which has been discharged from the traveling grate and is not to be recycled is cooled in a cooler and the heated cooling gases are used to preheat oil-containing mineral and/or to heat gases which are to be supplied to the process. The mineral which is not to be recycled is preferably cooled in direct contact with air to a temperature at which the material can be carried away. The heat content of the heated cooling air or the hottest portion thereof can then be utilized for the process in a desirable manner.

BRIEF DESCRIPTION OF DRAWINGS

The invention will be explained more in detail with reference to the drawing, which is a flow diagram showing one mode for carrying out the invention.

The retorting shaft reactor 1 has two double lock chambers 2*a*, 2*b* and 3*a*, 3*b*. When the lock chamber 2*a* is open, hot burnt material which has been recycled is charged to the lock chamber 2*b* by means of a conveyor 4. When the lock chamber 3*a* is open, oil-containing mineral is charged to the lock chamber 3*b* by means of a conveyor 5. The lock chambers 2*a* and 3*a* are then closed and the lock chambers 2*b* and 3*b* are opened so that the material is distributed over the surface of the mixed minerals 6 by means of distributors, not shown.

Retort gas from which oil has been removed is supplied at a low rate through an annular duct 7 to the upper portion of the retorting reactor 1. The gases from the retorting reactor 1 are fed through the suction box 8 and the duct 9 to the separating stage 10. The partly retorted mineral is removed from the retorting reactor 1 through the discharge opening 11 and is charged onto the traveling grate 12 to form thereon a bed 13 having a defined height. Retort gases from which oil has been removed are introduced into the after-retorting zone 14 through the gas hood 15 and are passed through the bed 13. The retort gases from the after-retorting zone 14 are fed through the suction boxes 16 and ducts 17 to the separating stage 10. The oil separated in the separating stage is discharged through conduit 18. The retort gases from which oil has been removed and which contain the non-condensible retorting products are fed in respective parts through duct 19 to the annular duct 7, through duct 20 to the gas hood 15 and through duct 21 to the ignition furnace 22 at the beginning of the combustion zone 23 and another part is discharged through duct 24.

When the solid carbon in the surface of the bed 13 under the igniting furnace 22 has been ignited in the combustion zone 23, air 25 is sucked through the bed 13 in the combustion zone 23 so that the burning zone is caused to move through the bed 13 from top to bottom. The rate of the air 25 is so controlled that preferably the bed 13 has the highest possible temperature at the end of the combustion zone 23 so that the exhaust gases will also have the highest possible temperature. The hot exhaust gases are supplied through suction boxes 26 and a duct 27 to the dryer-preheater 28, which is supplied at 28*a* with fresh oil-containing material. The preheated mineral is charged by means of the conveyor 5 to the retorting reactor 1. The cooled exhaust gas is fed through conduit 29 to the gas cleaning unit 30 and is discharged from the latter through the stack 31. The hot bed 13 is discharged from the traveling grate 12 into a dividing stage 32, where the part required for retorting in the retorting reactor is divided and then fed by a conveyor 33 to the reheater 34, in which the material is reheated by means of a partial stream (not shown) of the gases from which oil has been removed in the separating stage 10. The reheated material is charged into the retorting reactor 1 by the conveyor 4.

The remaining hot material from the dividing station 32 is charged into a cooler 33 and is cooled therein by means of air 34 to a temperature at which it can be carried away. The cooled material is carried away at 35. The heated cooling air is withdrawn in duct 36 and is used to heat (not shown) the gases in ducts 19, 20, 21 and the gases to be supplied to the reheater. The duct 20 can be closed when the duct 35 represented by a dotted line is open but in that case the gas cannot be supplied under different pressures to the retorting reactor 1 and the after-retorting zone 14.

The advantages afforded by the invention reside in that the retorting can be effected at much lower costs as a disintegration is required only where very large lumps are supplied. Additionally, very high throughput rates can be effected with relatively low expenditure. Equipment can be used which is known to operate satisfactorily and has been used in other fields for many years in process carried out at high throughput rates.

The process of the invention is especially useful in the treatment of oil-containing minerals which at least in part are in the form of large lumps, e. g., lumps having a dimension in at least one direction of at least 5 mm. Generally speaking, such lumps have a particle dimension of between 5 and 50 mm and can comprise at least 75 and up to 100 percent by weight of the entire charge of oil-containing minerals.

What is claimed is:

1. In a process of recovering oil from an oil-containing mineral by retorting said oil containing material and separating of oil in a separating stage from the retort gases obtained therefrom which contain the retorting products, and solid carbon contained in the retorted material after the retorting is burnt by a supply of oxygen-containing gases, part of the resultant burnt hot mineral in admixture with the oil-containing mineral is charged into a retorting shaft reactor whereby the oil-containing mineral is heated and retorted, the improvement wherein at least a portion of the retorting is effected in a retorting shaft reactor, the mineral from the retorting reactor is charged onto a traveling grate, a subsequent retorting is effected in an after-retorting zone, in which inert or reducing gases are passed through the material, the gases from the retorting reactor and from the after-retorting zone are supplied to the said separating stage and oil is removed from said gases in said separating stage, the retorted bed of material is moved on the traveling grate to a combustion zone, said solid carbon contained in said mineral in the surface of said bed is ignited at the beginning of the combustion zone, oxygen-containing gases are then sucked through the bed to cause the burning zone to move through the bed, the resultant burnt mineral is discharged from the traveling grate and part of the fired mineral is recycled to the retorting reactor.

2. A process according to claim 1, wherein the oxygen containing gases are sucked through the bed of said combustion zone at a rate which provides the highest possible temperature from the combustion of said solid carbon.

3. A process according to claim 1, wherein the retorting reactor is arranged over the first portion of the traveling grate and the gases from the retorting reactor are sucked through the traveling grate.

4. A process according to claim 1, wherein inert or reducing gases are supplied to the upper portion of said retorting shaft reactor.

5. A process according to claim 1, wherein a partial stream of the gases from which oil has been removed is supplied as retort gas to the retorting stages.

6. A process according to claim 1, wherein said inert or reducing gases are supplied to the retorting shaft reactor at a lower rate per unit of material than to the after-retorting zone.

7. A process according to claim 1, wherein the partial stream of the burnt material to be recycled is reheated before it is charged to the retorting reactor.

8. A process according to claim 1, wherein the heat of the exhaust gas from the combustion zone is used to dry and preheat the oil-containing material and/or to heat gases to be supplied to the process.

9. A process according to claim 1, wherein the hot mineral which has been discharged from the traveling grate and is not to be recycled is cooled in a cooler and the heated cooling gases are used to preheat oil-containing mineral and/or to heat gases which are to be supplied to the process.

* * * * *